US008345404B2

(12) United States Patent
Nozoe et al.

(10) Patent No.: US 8,345,404 B2
(45) Date of Patent: Jan. 1, 2013

(54) ANTI-STATIC PART AND ITS MANUFACTURING METHOD

(75) Inventors: Kenji Nozoe, Fukui (JP); Takeshi Iseki, Fukui (JP); Takashi Morino, Fukui (JP); Hideaki Tokunaga, Osaka (JP)

(73) Assignee: Panasonic Corporation, Osaka (JP)

( * ) Notice: Subject to any disclaimer, the term of this patent is extended or adjusted under 35 U.S.C. 154(b) by 812 days.

(21) Appl. No.: 12/439,745

(22) PCT Filed: Oct. 19, 2007

(86) PCT No.: PCT/JP2007/070410

§ 371 (c)(1),
(2), (4) Date: Mar. 3, 2009

(87) PCT Pub. No.: WO2008/053717

PCT Pub. Date: May 8, 2008

(65) Prior Publication Data

US 2010/0188791 A1 Jul. 29, 2010

(30) Foreign Application Priority Data

Oct. 31, 2006 (JP) ..... 2006-295147
Oct. 31, 2006 (JP) ..... 2006-295148
Nov. 20, 2006 (JP) ..... 2006-312598

(51) Int. Cl.
*H05F 3/02* (2006.01)

(52) U.S. Cl. ..... 361/220; 361/56; 361/212

(58) Field of Classification Search ..... 361/112, 361/220, 56

See application file for complete search history.

(56) References Cited

U.S. PATENT DOCUMENTS 5,097,247 A * 3/1992 Doerrwaechter ..... 337/405
6,013,358 A 1/2000 Winnett et al.
6,160,695 A * 12/2000 Winnett et al. ..... 361/111
6,191,928 B1 * 2/2001 Rector et al. ..... 361/127
6,238,992 B1 * 5/2001 Yamada ..... 438/382
7,851,863 B2 * 12/2010 Tokunaga et al. ..... 257/355
2004/0113541 A1 * 6/2004 Watanabe et al. ..... 313/500
2004/0125530 A1 7/2004 Tominaga et al.

(Continued)

FOREIGN PATENT DOCUMENTS

JP 60-074551 * 4/1985

(Continued)

OTHER PUBLICATIONS

International Search Report issued Jan. 22, 2008 in the International (PCT) Application of which the present application is the U.S. National Stage.

(Continued)

*Primary Examiner* — Jared Fureman
*Assistant Examiner* — Nicholas Ieva
(74) *Attorney, Agent, or Firm* — Wenderoth, Lind & Ponack, L.L.P.

(57) ABSTRACT

A conductive layer mainly made of gold is formed on an upper surface of an insulating substrate. Plural electrodes facing each other via a gap is formed by forming the gap in the conductive layer. An overvoltage protective layer covering the gap and a portion of each of the plurality of electrodes is formed. This method can provide the gap with a narrow width precisely, and thereby, provide an electrostatic (ESD) protector with a low peak voltage, stable characteristics of suppressing electrostatic discharge, and a high resistance to sulfidation.

17 Claims, 15 Drawing Sheets

U.S. PATENT DOCUMENTS

| | | | | |
|---|---|---|---|---|
| 2006/0185163 | A1 | 8/2006 | Sato et al. | |
| 2007/0019346 | A1* | 1/2007 | Kim et al. | 361/56 |
| 2009/0027157 | A1* | 1/2009 | Katsumura et al. | 338/21 |

FOREIGN PATENT DOCUMENTS

| | | |
|---|---|---|
| JP | 64-037805 | 2/1989 |
| JP | 8-293377 | 11/1996 |
| JP | 2001-504635 | 4/2001 |
| JP | 2001-230046 | 8/2001 |
| JP | 2002-015831 | 1/2002 |
| JP | 2002-538601 | 11/2002 |
| JP | 2003-297606 | 10/2003 |
| JP | 2004-214005 | 7/2004 |
| JP | 2006-229031 | 8/2006 |
| WO | 98/23018 | 5/1998 |
| WO | 00/51152 | 8/2000 |

OTHER PUBLICATIONS

Machine English translation of JP 8-293377, Nov. 1996.

* cited by examiner

Fig. 7

| Thickness of Protective Resin Layer 5 | Voltage of Electrostatic Pulse | | | | |
|---|---|---|---|---|---|
| | 10kV | 15kV | 20kV | 25kV | 30kV |
| 15μm | 0 | 3 | 6 | 12 | 27 |
| 20μm | 0 | 0 | 2 | 5 | 10 |
| 25μm | 0 | 0 | 1 | 3 | 6 |
| 30μm | 0 | 0 | 0 | 1 | 2 |
| 35μm | 0 | 0 | 0 | 0 | 0 |

Fig. 8

| | Voltage of Electrostatic Pulse | | | |
|---|---|---|---|---|
| | 15kV | 20kV | 25kV | 30kV |
| Comparative Example | 0 | 1 | 2 | 4 |
| Embodiment 1 | 0 | 0 | 0 | 0 |

Fig. 9

| Length L of Long Side | Length W of Short Side | Length L1 of Electrode 2 | (L-0.1)/(W-0.1) | Number of Breaking Samples |
|---|---|---|---|---|
| 1.4mm | 1.1mm | 1.2mm | 1.3 | 6 |
| 1.6mm | 1.1mm | 1.4mm | 1.5 | 0 |
| 1.8mm | 1.1mm | 1.6mm | 1.7 | 0 |
| 2.0mm | 1.1mm | 1.8mm | 1.9 | 0 |

ANTI-STATIC PART AND ITS MANUFACTURING METHOD

TECHNICAL FIELD

The present invention relates to an electrostatic discharge (ESD) protector for protecting an electronic device from static electricity and to a method for manufacturing the protector.

BACKGROUND ART

Electronic devices, such as portable telephones, have recently had small sizes and high performance, and electronic components used in the electronic devices are required to have small sizes. Accordingly, these electronic devices and the electronic components have had low withstanding voltages. Upon being touched by a human body, an electrostatic pulse applies, to an electronic circuit of an electronic device, a high voltage ranging from several hundred volts to several kilovolts and having a rising time shorter than one nanosecond, and may break an electronic component.

In order to protect the electronic component from breaking, an electrostatic discharge (ESD) protector is connected between a line receiving the electrostatic pulse and the ground. A signal transmission line has had a high transmission speed higher than several hundred megabits per second. Upon having a large stray capacitance, the ESD protector may degrade signal quality. In order to protect an electronic component operating at a high transmission speed higher than several hundred megabits per second from breaking, the ESD protector is required to have a capacitance equal to or smaller than 1 pF.

Each of Patent Documents 1 and 2 discloses a conventional ESD protector including an overvoltage protective material filling a gap between two electrodes facing each other. When an excessive voltage caused by static electricity is applied between the electrodes, a current flows between conductive particles or semiconductor particles dispersed in the overvoltage protective material. Thus, the ESD protector allows the current flowing due to the excessive voltage to bypass the electronic component and flow to the ground.

In the conventional ESD protector, if the applied voltage is higher than 15 kV, an electrostatic discharge generates a large repulsive force, and may chip a protective resin layer covering the overvoltage protective material and cause the protector to break.

In order to lower a peak voltage applied to the ESD protector and improve characteristics of suppressing electrostatic discharge, it is required that a gap is precisely narrow. In the conventional ESD protector disclosed in Patent Document 1, the gap between the electrodes is formed by a photolithography technique and an etching process based mainly on chemical reactions. This method may cause the gap to have a width smaller than a predetermined width due to foreign matter attached to the gap at light exposure, or insufficient development, or insufficient etching.

The conventional ESD protector disclosed in Patent Document 1 is provided by forming electrodes and functional elements on an insulating substrate having a sheet shape, and then, dividing the insulating substrate into strips or separate pieces by a dicing technique. This dividing process may produce burrs on the divided surfaces, thus preventing ESD protectors from having small sizes stably.

In the conventional ESD protector disclosed in Patent Document 2, a gap is formed by cutting an electrode with laser. Since the electrode has a thickness ranging approximately from 10 to 20 μm, a high laser output is necessary for reliably cutting the electrode to form the gap precisely, thus preventing the gap from having a narrow width precisely.

Patent Document 1: JP 2002-538601A

Patent Document 2: JP 2002-015831A

SUMMARY OF THE INVENTION

A conductive layer mainly made of gold is formed on an upper surface of an insulating substrate. Plural electrodes facing each other via a gap is formed by forming the gap in the conductive layer. An overvoltage protective layer covering the gap and a portion of each of the plurality of electrodes is formed.

This method can provide the gap with a narrow width precisely, and thereby, provide an electrostatic (ESD) protector with a low peak voltage, stable characteristics of suppressing electrostatic discharge, and a high resistance to sulfidation.

BRIEF DESCRIPTION OF THE DRAWINGS

FIG. 7 shows results of the electrostatic test on the ESD protector in accordance with Embodiment 1.

FIG. 8 shows results of the electrostatic test on the ESD protector in accordance with Embodiment 1.

FIG. 9 shows results of the electrostatic test on the ESD protector in accordance with Embodiment 1.

REFERENCE NUMERALS

1 Insulating Substrate
2A Electrode
2B Electrode
2C Gap
3 Overvoltage Protective Layer
4 Intermediate Layer
5 Protective Resin Layer
101 Insulating Substrate
102 Conductive Layer
102A Electrode
102B Electrode
10C Gap
104 Overvoltage Protective Layer
105 Intermediate Layer
106 Protective Resin Layer
201 First Dividing Line
202 Second Dividing Line
203 Insulating Substrate
204 Conductive Layer
206 Gap
205 Resist
208 Upper Electrode
209 Lower Electrode
209A First Portion of Lower Electrode
209B Second Portion of Lower Electrode
210 Overvoltage Protective Layer
211 Intermediate Layer
212 Protective Resin Layer
213 Edge Electrode
214 Nickel-Plated Layer
215 Tin-Plated Layer
1203 Insulating Substrate Strip

DETAILED DESCRIPTION OF PREFERRED EMBODIMENTS

Exemplary Embodiment 1

Figure 1A:
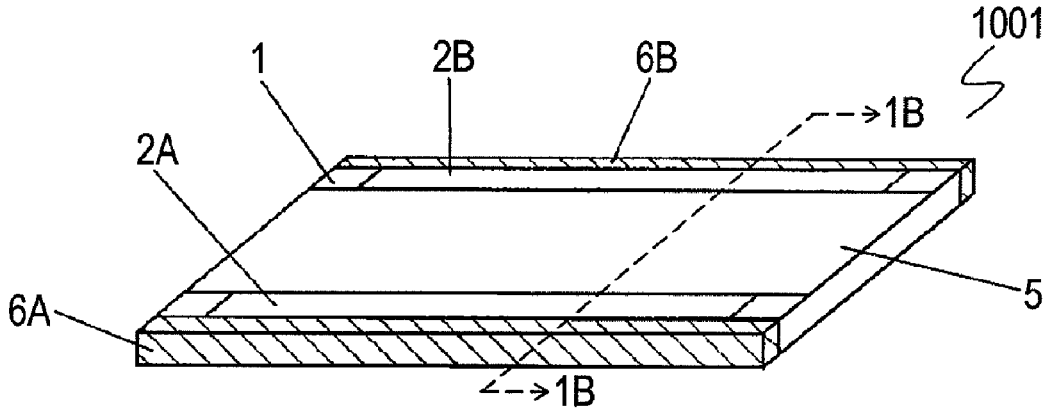
FIG. 1A is a perspective view of an electrostatic discharge (ESD) protector in accordance with Exemplary Embodiment 1 of the present invention.
Figure 1B:
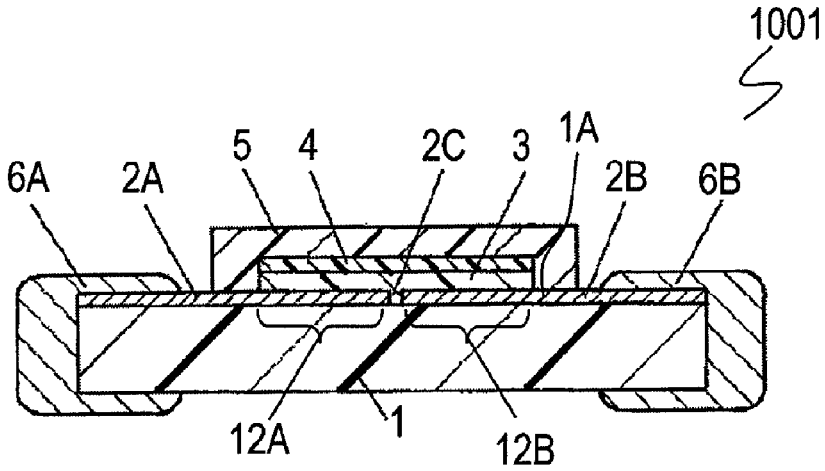
FIG. 1B is a sectional view of the ESD protector at line 1B-1B shown in FIG. 1A.

FIG. 1A is a perspective view of electrostatic discharge (ESD) protector 1001 in accordance with Exemplary Embodiment 1 of the present invention. FIG. 1B is a sectional view of ESD protector 1001 at line 1B-1B shown in FIG. 1A. Insulating substrate 1 is made of dielectric ceramic, such as alumina, having a low dielectric constant smaller than 50, preferably smaller than 10. Electrodes 2A and 2B are provided on surface (upper surface) 1A of insulating substrate 1. Electrode 2A faces electrode 2B across gap 2C having a predetermined interval. Overvoltage protective layer 3 covers portion 12A of electrode 2A, portion 12B of electrode 2B, and gap 2C. Overvoltage protective layer 3 contains insulating resin, such as silicone resin, and conductive particles, such as metal powder, dispersed in the insulating resin. Intermediate layer 4 is provided on overvoltage protective layer 3 so as to cover overvoltage protective layer 3. The intermediate layer contains insulating resin, such as silicone resin, and insulating powder dispersed in the insulating resin. Protective resin layer 5 is provided on intermediate layer 4 so as to completely cover intermediate layer 4. Terminal electrodes 6A and 6B connected to electrodes 2A and 2B are provided at both ends of insulating substrate 1, respectively.

Figure 1C:
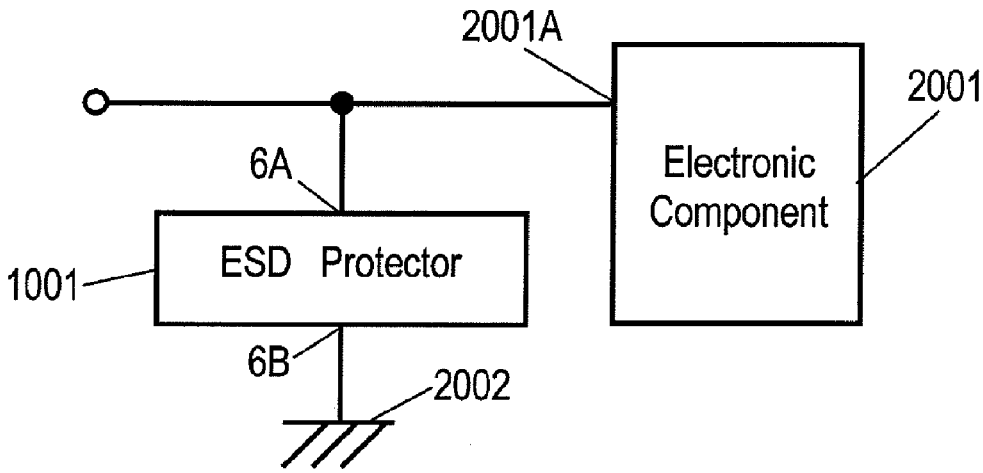
FIG. 1C is a schematic view for illustrating an operation of the ESD protector in accordance with Embodiment 1.

An operation of ESD protector 1001 will be described below. FIG. 1C is a schematic diagram illustrating the operation of ESD protector 1001. Terminal electrode 6A of ESD protector 1001 is connected to terminal 2001A of electronic component 2001, and terminal electrode 6B of the ESD protector is connected to ground 2002. When a voltage applied to terminal 2001A of electronic component 2001, i.e. applied between terminal electrodes 6A and 6B, is lower than a predetermined rated voltage, the insulating resin of overvoltage protective layer 3 provided in gap 2C insulates between electrode 2A and 2B, thus electrically insulating and opening between terminal electrodes 6A and 6B. When a high voltage caused by, e.g. an electrostatic pulse, is applied between terminal electrodes 6A and 6B, a discharge current flows between the conductive particles dispersed in the insulating resin of overvoltage protective layer 3, thus drastically decreasing impedance between terminal electrodes 6A and 6B. The current generated by the high voltage accordingly flows to ground 2002 via ESD protector 1001, as the discharge current in ESD protector 1001. The ESD protector allows the current generated by an abnormal voltage, such as an electrostatic pulse or surge, to bypass electronic component 2001 and flow to ground 2002.

A method for manufacturing ESD protector 1001 will be described below. FIGS. 2 to 5 are perspective views of ESD protector 1001 for illustrating the method for manufacturing ESD protector 1001.

Figure 2:
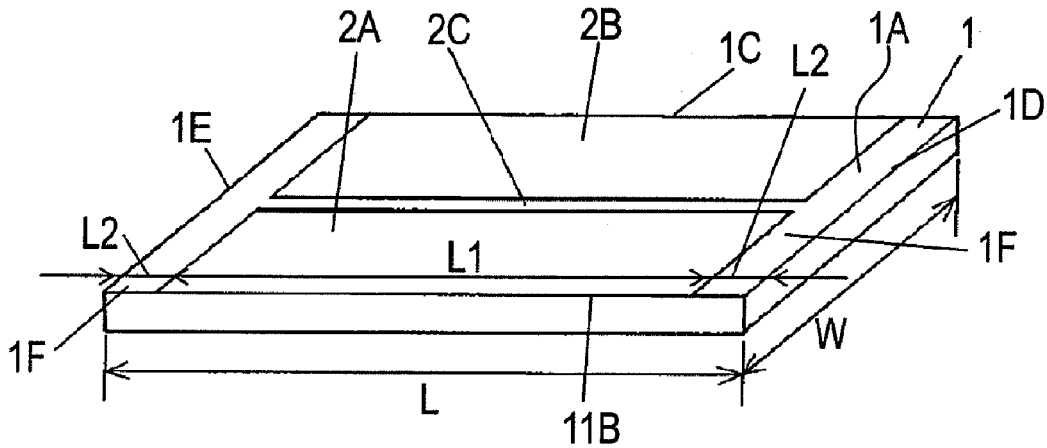
FIG. 2 is a perspective view of the ESD protector for illustrating a method for manufacturing the ESD protector in accordance with Embodiment 1.

First, dielectric ceramic material, such as alumina, having a low dielectric constant smaller than 50, preferably smaller than 10is fired at a temperature ranging from 900 to 1700° C., thereby providing insulating substrate 1. Insulating substrate 1 has rectangular surface 1A. Surface 1A has long sides 11B and 1C facing each other, and short sides 1D and 1E being shorter than long sides 11B and 1C and facing each other. As shown in FIG. 2, metal of Cu, Ag, Au, Cr, Ni, Al, Pd, or an alloy thereof is provided on surface 1A of insulating substrate 1 by a method, such as sputtering, vapor deposition, printing, or firing, to form electrodes 2A and 2B. Electrodes 2A and 2B facing each other via gap 2C have thicknesses ranging from 10 nm to 20 μm. Electrodes 2A and 2B extend along long sides 11B and 1C of surface 1A of insulating substrate 1, respectively. According to Embodiment 1, length L of each of long sides 11B and 1C is 2.0 mm, and length W of each of short sides 1D and 1E is 1.2 mm. When the metal is provided on surface 1A to form electrodes 2A and 2B, margin 1F is provided at both ends of each of long sides 11B and 1C. According to Embodiment 1, length L2 of margin 1F is 0.05 mm. Thus, if each of long sides 11B and 1C has length L (mm)=2.0 mm, length L1 (mm) of each of electrodes 2A and 2B along long sides 11B and 1C is 1.8 mm. Electrodes 2A and 2B facing each other via gap 2C may be formed by providing the metal on surface 1A with using a metal mask or a resist mask.

Alternatively, metal including a portion to be gap 2C is provided on surface 1A to form electrodes 2A and 2B connected to each other, and then, the metal is etched by a photolithography technique to form gap 2C. Alternatively, metal including a portion to be gap 2C is provided on surface 1A to form electrodes 2A and 2B connected to each other, and then, the metal is cut with laser to form gap 2C. Overvoltage protective layer 3 is more effective when gap 2C is narrower. The interval of gap 2C may be preferably equal to or smaller than 50 μm. In order to control gap 2C to provide gap 2C with the narrow interval, gap 2C may be preferably formed by photolithography technique or laser.

Figure 3:
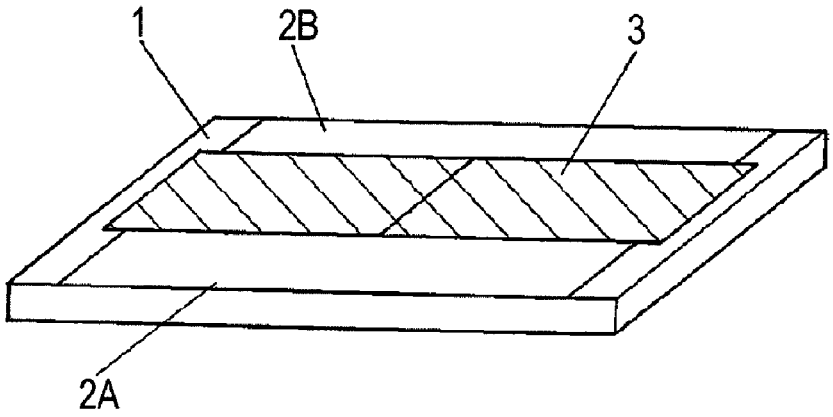
FIG. 3 is a perspective view of the ESD protector for illustrating a method for manufacturing the ESD protector in accordance with Embodiment 1.

Next, overvoltage protective layer 3 is formed. Metal powder containing spherical particles having an average particle diameter ranging from 0.3 to 10 μm and being made of Ni, Al, Ag, Pd, or Cu is mixed and kneaded with silicone resin, such as methyl silicone resin, and an organic solvent with a three-roll mill to disperse the power in the resin and the solvent, thereby providing overvoltage protective material paste. As shown in FIG. 3, this overvoltage protective material paste is applied onto portion 12A of electrode 2A, portion 12B of electrode 2B, and gap 2C to have a thickness ranging from 5 to 50 μm by screen printing, and dried at a temperature of 150° C. for a time ranging from 5 to 15 minutes, thereby providing overvoltage protective layer 3.

Figure 4:
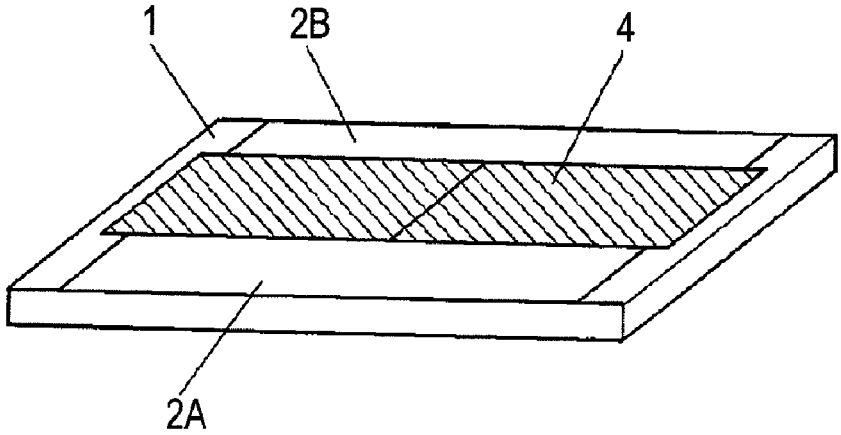
FIG. 4 is a perspective view of the ESD protector for illustrating a method for manufacturing the ESD protector in accordance with Embodiment 1.

Next, intermediate layer 4 is formed. Insulating powder having an average particle diameter ranging from 0.3 to 10 μm and being made of $Al_2O_3$, $SiO_2$, MgO, or composite oxide thereof is prepared. This insulating powder is mixed and kneaded with silicone resin, such as methyl silicone resin, and organic solvent with a three-roll mill to disperse the insulating particles in the resin and the solvent, thereby providing insulating paste. As shown in FIG. 4, this insulating paste is applied onto overvoltage protective layer 3 to cover overvoltage protective layer 3, particularly to completely cover a portion of overvoltage protective layer 3 over gap 2C, and to have a thickness ranging from 5 to 50 μm by screen printing. The applied insulating paste is dried at a temperature of 150° C. for a time ranging from 5 to 15 minutes, thereby providing intermediate layer 4. In order to provide a sufficient electrostatic discharge protection, the sum of the thicknesses of overvoltage protective layer 3 and intermediate layer 4 is determined to be equal to or larger than 30 μm. If overvoltage protective layer 3 has a large thickness to provide a predetermined electrostatic discharge protection, intermediate layer 4 may not necessarily be provided.

Figure 5:
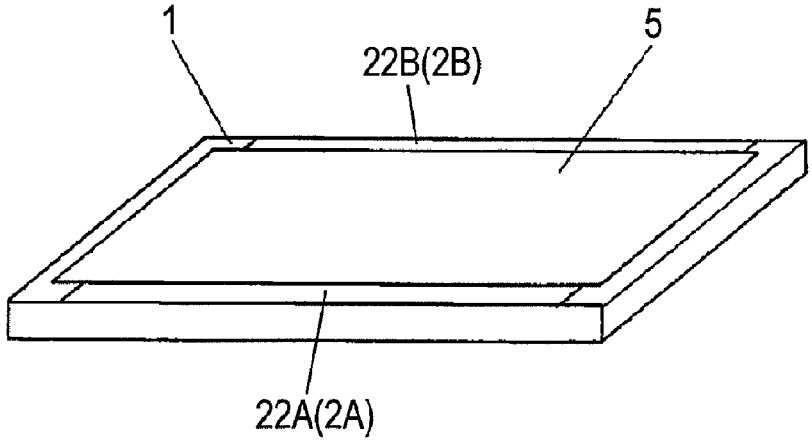
FIG. 5 is a perspective view of the ESD protector for illustrating a method for manufacturing the ESD protector in accordance with Embodiment 1.

Next, protective resin layer 5 is formed. As shown in FIG. 5, a resin paste made of epoxy resin or phenol resin is printed by screen printing to completely cover intermediate layer 4 and overvoltage protective layer 3 and to expose ends 22A and 22B of electrodes 2A and 2B. The applied resin paste is dried at a temperature of 150° C. for a time ranging from 5 to 15 minutes, and then, cured at a temperature ranging from 150 to 200° C. for a time ranging from 15 to 60 minutes, thereby providing protective resin layer 5.

Next, as shown in FIG. 1A, conductive paste containing powder of metal, such as Ag, and a curing resin, such as epoxy resin, is applied onto ends 22A and 22B of electrodes 2A and 2B to form terminal electrodes 6A and 6B, respectively, thereby providing ESD protector 1001.

Figure 6:
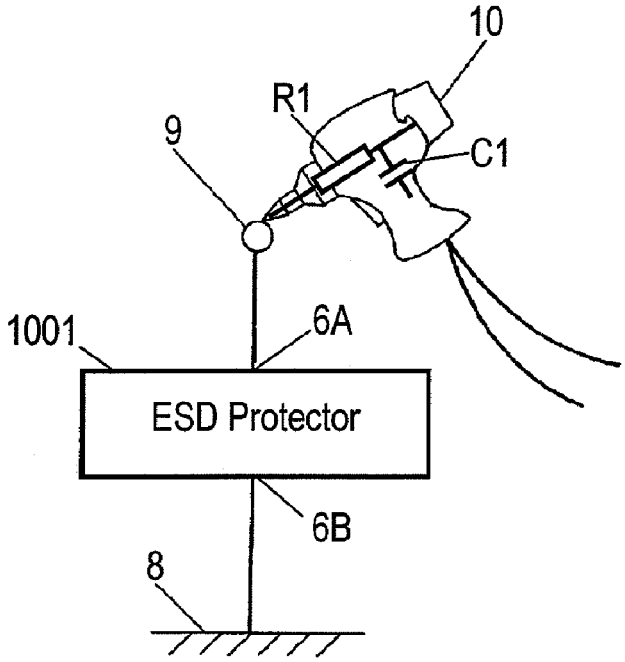
FIG. 6 is a schematic diagram for illustrating a method for conducting an electrostatic test on the ESD protector in accordance with Embodiment 1.

The following test was conducted on samples of ESD protector 1001 fabricated by the above method. FIG. 6 is a schematic diagram illustrating the method for testing the samples. While terminal electrode 6B of ESD protector 1001 was grounded to ground 8, static-electricity generator 10 contacted terminal 9 connected to terminal electrode 6A to apply an electrostatic pulse. Electrostatic generator 10 included discharge resistance R1 of 330Ω and discharge capacitance C1 of 150 pF.

Five types of samples of ESD protector 1001 were fabricated by the above method so that protective resin layer 5 of the samples after drying had different thicknesses ranging from 15 μm to 35 μm by 5 μm steps. Thirty pieces were fabricated for each type. The above test is conducted on these samples. An electrostatic pulse having a voltage changing from 10 kV to 30 kV by 5 kV steps was applied to each samples of ESD protector 1001. FIG. 7 shows the number of broken pieces samples including chipped protective resin layers 5 out of the 30 pieces of each type.

As shown in FIG. 7, some of the samples including protective resin layers 5 having a thickness of 15 μm broke at voltages equal to or higher than 15 kV. The samples having protective resin layers 5 having a thickness of 20 μm did not break even at a voltage of 15 kV. This result shows that protective resin layer 5 has a thickness equal to or larger than 20 μm, in order not to break at a voltage of 15 kV, which exceeds the maximum level defined in the IEC-61000 standard.

As shown in FIG. 7, in order not to be broken at voltages higher than the above voltage, protective resin layer 5 has a thickness equal to or larger than 35 μm. The upper limit of the thickness of protective resin layer 5 is determined by the dimensions of ESD protector 1001 and the upper limit of the thickness of application provided in one printing operation. From this point of view, the thickness of protective resin layer 5 may preferably be 60 μm.

Thirty pieces of a comparative example of the ESD protector including electrodes 2A and 2B extending along short sides 1D and 1E of insulating substrate 1, respectively, were fabricated. FIG. 8 shows the number of pieces having protective resin layers 5 broken out of the 30 pieces of the comparative example and 30 pieces of ESD protector 1001 according to Embodiment 1. The samples of the comparative example and Embodiment 1 included protective resin layer 5 having a thickness of 35 μm.

As shown in FIG. 8, some of the samples of the comparative example include the protective resin layers chipped by the repulsive force of electrostatic discharge at voltages equal to or higher than 20 kV. In contrast, no sample of ESD protector 1001 was broken even at a high voltage of 30 kV.

In ESD protector 1001 of Embodiment 1, electrodes 2A and 2B extend along long sides 11B and 1C, respectively, of insulating substrate 1, and the thickness of protective resin layer 5 is equal to or larger than 20 μm, preferably larger than 35 μm. This structure has a larger discharge area in gap 2C covered with overvoltage protective layer 3 when an electrostatic pulse is applied. Further, protective resin layer 5 is thick so that layer 5 can ensure a high physical breaking strength. Thus ESD protector 101 prevents protective resin layer 5 from breaking even if a high-voltage electrostatic pulse is applied.

When a high-voltage electrostatic pulse is applied, discharge sparks occur between the metal particles in overvoltage protective layer 3. As the applied voltage increases, the discharge sparks increase, thus breaking intermediate layer 4 and protective resin layer 5. Intermediate layer 4 prevents insulation property of protective resin layer 5 from deteriorating, and mainly contains resin, such as methyl silicone resin, having side chains of small hydrocarbon radical out of silicone resins. Thus, intermediate layer 4 has a relatively low physical breaking strength. Protective resin layer 5 is made of resin, such as epoxy resin and phenol resin, having a relatively high physical breaking strength, and has a thickness equal to or larger than 20 μm, preferably larger than 35 μm. Electrodes 2A and 2B extend along long sides 11B and 1C, respectively, of insulating substrate 1, and allows gap 2C to be substantially parallel to long sides 11B and 1C of insulating substrate 1. This structure can increase the physical breaking strength of electrodes 2A and 2B against a bending stress.

30 pieces of samples were fabricated for each of four different types of comparative examples of ESD protector 1001. In these four types, the length W of each of short sides 1D and 1E of insulating substrate 1 was 1.1 mm, and the length L of each of long sides 11B and 1C ranged from 1.4 mm to 2.0 mm by 0.2 mm steps. FIG. 9 shows the results of an electrostatic test on these samples. In these samples, electrodes 2A and 2B extend along long sides 11B and 1C, respectively, of insulating substrate 1. The length L2 of margin 1F from each of both ends of insulating substrate 1 along long sides 11B and 1C need be equal to or larger than 0.05 mm. In each of these samples, the length L2 of each margin 1F was 0.1 mm, and the width L1 of each of electrodes 2A and 2B along long sides 1B and 1C was shown in FIG. 9.

As shown in FIG. 9, each of long sides 11B and 1C of insulating substrate 1 has a length of L (mm), and each of short sides 1D and 1E thereof has a length of W (mm). Samples included protective resin layer 5 which was not broken even if an electrostatic pulse having a voltage of 30 kV was applied, and had a high electrostatic discharge resistance (ESD resistance) if the samples satisfy the following condition.

$$(L-0.1)/(W-0.1) \geqq 1.5,$$

Metal is provided on surface 1A of insulating substrate 1 to form electrodes 2A and 2B. As described above, margins 1F are provided for forming the metal. For this reason, the above condition is established not according to a ratio of L to W, but to a ratio of (L−0.1) to (W−0.1). Under this condition, the maximum width W and length L of electrodes 2A and 2B in consideration of the margins 1F can be defined. The length L2 of margin 1F along long sides 11B and 1C need be set to at least 0.05 mm at each of both ends of insulating substrate 1. Thus, in consideration of margins 1F, the length L1 of each of electrodes 2A and 2B along long sides 11B and 1C that can be provided on surface 1A of insulating substrate 1 is (L−0.1) (mm). The width of electrodes 2A and 2B and gap 2C along short sides 1D and 1E is (W−0.1) (mm). Margins 1F can be smaller according to the method for providing the metal.

In ESD protector 1001 of Embodiment 1, protective resin layer 5 has a large thickness to have a higher physical breaking strength. In ESD protector 1001 of Embodiment 1, surface 1A of insulating substrate 1 is roughened to have a large anchor effect which increases the junction area between protective resin layer 5 and insulating substrate 1. This structure can increase the adhesion strength between protective resin layer 5 and insulating substrate 1, thereby increasing the physical breaking strength of protective resin layer 5. Alternatively, the amount of fillers in protective resin layer 5 may be increased, or the size of the fillers may be reduced. This can increase the adhesion strength between protective resin layer 5 and insulating substrate 1, thereby increasing the physical breaking strength of protective resin layer 5.

In the comparative example of the ESD protector, the electrodes extend along the short side of the insulating substrate, the long side has a length of 20 mm, and the short side had a length of 12 mm. The comparative example had a capacitance of approximately 0.10 pF. The ESD protector according to Embodiment 1 satisfied the condition, (L−0.1)/(W−0.1) ≧1.5, and had the same dimensions. The ESD protector according to Embodiment 1 had a capacitance of 0.15 pF, which is larger than higher than that of the comparative example. However, when an ESD protector is used for a transmission line at a relatively low speed in an electronic device, such as an on-vehicle device, to which an electrostatic pulse having an extremely high voltage may be applied, small capacitance is not matter. Thus, ESD protector 1001 according to Embodiment 1 can protect electronic component 2001 from an electrostatic pulse.

Exemplary Embodiment 2

Figure 10:
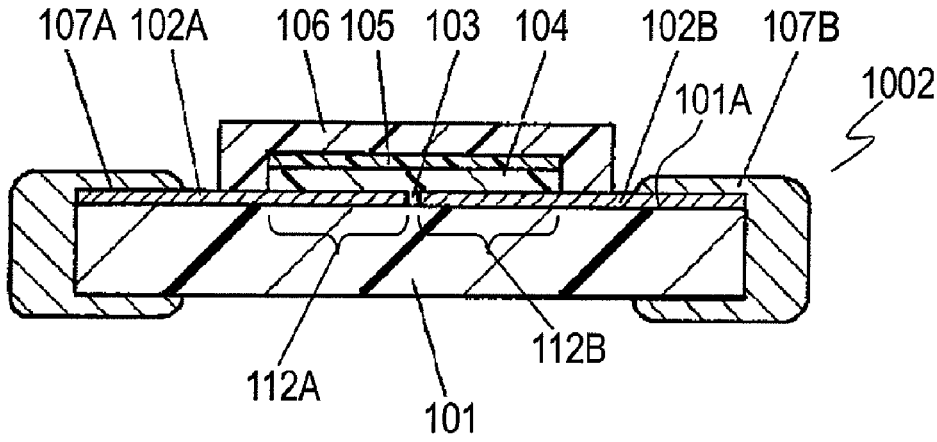
FIG. 10 is a sectional view of an ESD protector in accordance with Exemplary Embodiment 2 of the invention.

FIG. 10 is a sectional view of ESD protector 1002 in accordance with Exemplary Embodiment 2 of the present invention. FIGS. 11 to 18 are perspective views of manufacturing ESD protector 1002 for illustrating a method of manufacturing ESD protector 1002. Insulating substrate 101 is made of low-dielectric ceramic, such as alumina, having a low dielectric constant equal to or smaller than 50, preferably smaller than 10. Electrodes 102A and 102B are provided on surface (upper surface) 101A of insulating substrate 101.

Electrode 102A faces electrode 102B across gap 103 having a predetermined spacing. Overvoltage protective layer 104 covers portion 112A of electrode 102A, portion 112B of electrode 102B, and gap 103. Overvoltage protective layer 104 contains insulating resin, such as silicone resin, and conductive particles, such as metal powder, dispersed in the insulating resin. Intermediate layer 105 is provided on overvoltage protective layer 104 and covers overvoltage protective layer 104. Intermediate layer 105 contains insulating resin, such as silicone resin, and at least one kind of insulating powder dispersed in the insulating resin. Protective resin layer 106 is provided on intermediate layer 105 and completely cover intermediate layer 105. Terminal electrodes 107A and 107B are provided at both ends of insulating substrate 101 and are connected to electrodes 102A and 102B, respectively.

A method for manufacturing ESD protector 1002 according to Embodiment 2 will be described below.

Figure 11:
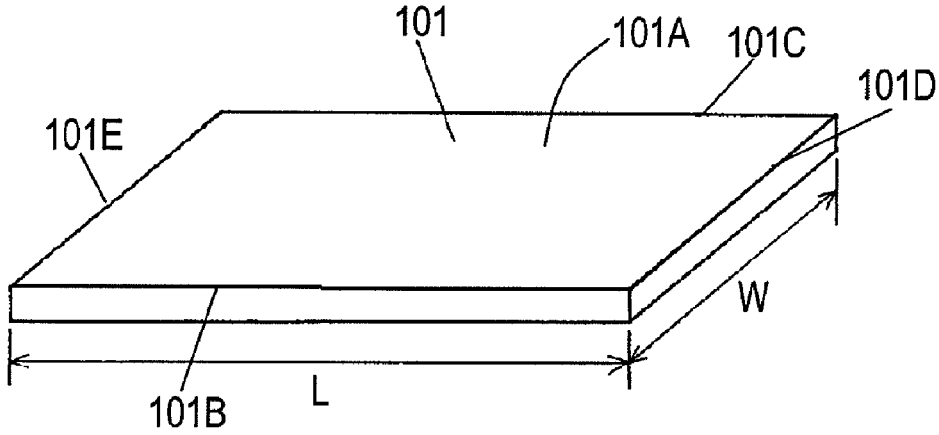
FIG. 11 is a perspective view of the ESD protector for illustrating a method for manufacturing the ESD protector in accordance with Embodiment 2.

First, as shown in FIG. 11, low-dielectric material, such as alumina, having a dielectric constant equal to or smaller than 50, preferably smaller than 10, is fired at temperatures ranging from 900 to 1300° C., thereby providing insulating substrate 101. Insulating substrate 101 has a rectangular shape, and has long sides 101B and 101C which face each other and have lengths L (mm), and short sides 101D and 101E which are shorter than long sides 101B and 101C and have lengths W (mm). In the actual manufacturing process, an insulating substrate made of low-dielectric ceramic is divided into plural pieces each providing insulating substrate 101.

Figure 12:
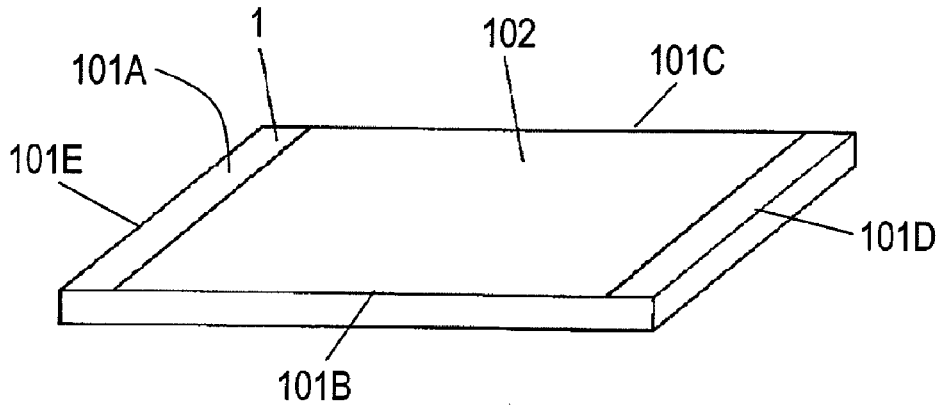
FIG. 12 is a perspective view of the ESD protector for illustrating a method for manufacturing the ESD protector in accordance with Embodiment 2.

Next, as shown in FIG. 12, conductive material containing more than 80 wt % of gold, that is, mainly containing gold is provided on surface 101A of insulating substrate 101, thereby providing conductive layer 102. The conductive material is gold-based organic paste (reginate paste), and conductive layer 102 is formed by printing and firing the material. This method allows conductive layer 102 to be manufactured more inexpensively at higher productivity than other methods, such as the sputtering of gold. The thickness of conductive layer 102 after the firing ranges from 0.2 μm to 2.0 μm. Conductive layer 102 reaches long sides 101 B and 101C, and is located away from short sides 101D and 101E of insulating substrate 101, thus providing spaces on surface 101A. The conductive layer may be located away from long sides 101B and 101C so as to provide the spaces.

Figure 13:
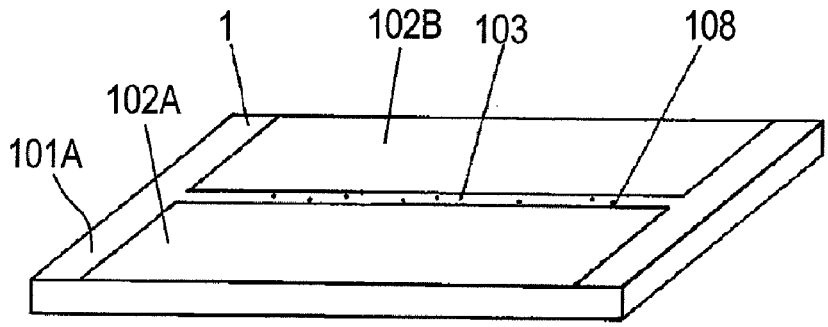
FIG. 13 is a perspective view of the ESD protector for illustrating a method for manufacturing the ESD protector in accordance with Embodiment 2.

Next, as shown in FIG. 13, a substantially central portion of conductive layer 102 is cut with UV laser to form gap 103 having a width of approximately 10 μm. This provides electrodes 102A and 102B facing each other across gap 103. Conductive layer 102 is formed by applying and firing the gold-based organic paste and is thin, hence forming gap 103 reliably and accurately with the UV laser having a relatively low output. Gap 103 is formed by physically cutting conductive layer 102 with the UV laser, hence having an insulating property prevented from deteriorating. In the case that gap 103 is formed by etching conductive layer 102 by a photolithography technique, glass frit contained in the gold-based organic paste may remain around gap 103 after the etching, and degrade its resistance to humidity. When conductive layer 102 is cut with the UV laser, matter 108, such as metal particles, may be attached onto gap 103 or surfaces of electrodes 102A and 102B around the gap. Gap 103 is substantially parallel to long sides 101B and 101C of insulating substrate 101. Gap 103 may be substantially parallel to short sides 101D and 101E of insulating substrate 101. In this case, conductive layer 102 may preferably be provided on surface 101A away from long sides 101B and 101C of insulating substrate 101. Gap 103 has a linear shape, and may have a stair shape or a meander shape.

Figure 14:
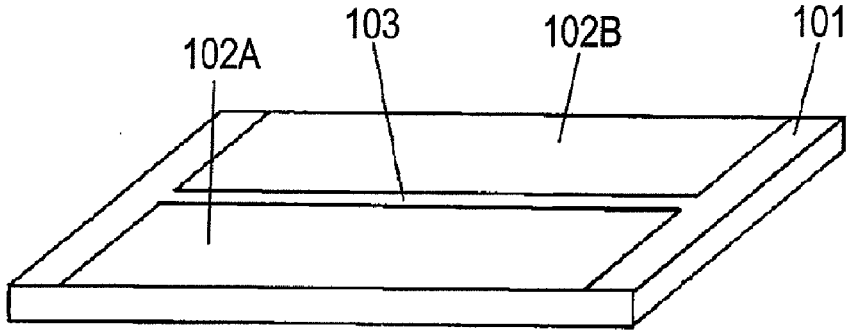
FIG. 14 is a perspective view of the ESD protector for illustrating a method for manufacturing the ESD protector in accordance with Embodiment 2.

Next, as shown in FIG. 14, insulating substrate 101, particularly gap 103, is cleaned with acidic solution, such as sulfuric acid, hydrofluoric acid, nitric acid, or mixed acid thereof, so as to remove attached matter 108. Since electrodes 102A and 102B contain more than 80 wt. % of gold, i.e. mainly containing gold, conductive components of the electrodes do not dissolve in the acidic solution even if contacting the solution. Therefore, attached matter 108 can be removed while gap 103 is not enlarged. Attached matter 108 contains metal particles that may cause an insulation failure. Then, insulating substrate 101 may be cleaned with ultrasonic waves, thereby having the attached matter 108 removed reliably. Alternatively, attached matter 108 may be physically removed by another method, such as blowing air, sucking air, or grinding, after the cleaning with the acidic solution, thereby having attached matter 108 removed reliably.

Figure 15:
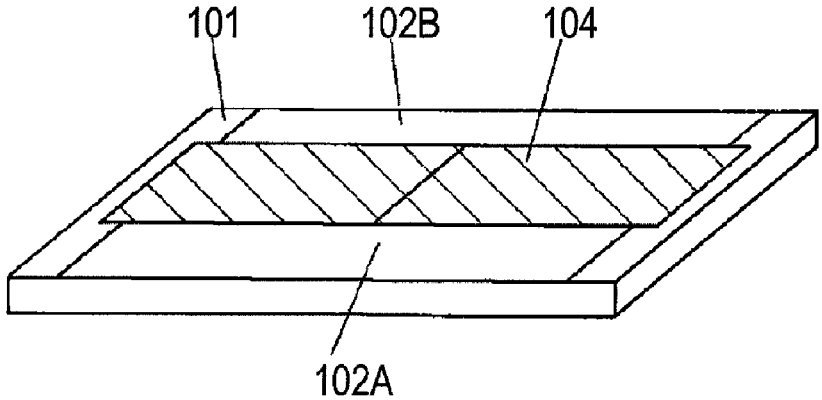
FIG. 15 is a perspective view of the ESD protector for illustrating a method for manufacturing the ESD protector in accordance with Embodiment 2.

Next, overvoltage protective layer 104 is formed. Metal particles, such as metal powder having spherical shapes and an average particle diameter ranging from 0.3 to 10 μm and made of Ni, Al, Ag, Pd, or Cu, is prepared. The metal particles, silicone-resin-based insulating resin, such as methyl silicone resin, and organic solvent are kneaded with a three-roll mill to have the particles dispersed in the solvent, thereby providing overvoltage protective material paste. As shown in FIG. 15, this overvoltage protective material paste is applied by screen printing to have a thickness ranging from 5 to 50 μm so as to cover portion 112A of electrode 102A, portion 112B of electrode 102B, and gap 103. The applied paste is dried at 150° C. for 5 to 15 minutes, thereby providing overvoltage protective layer 104.

Figure 16:
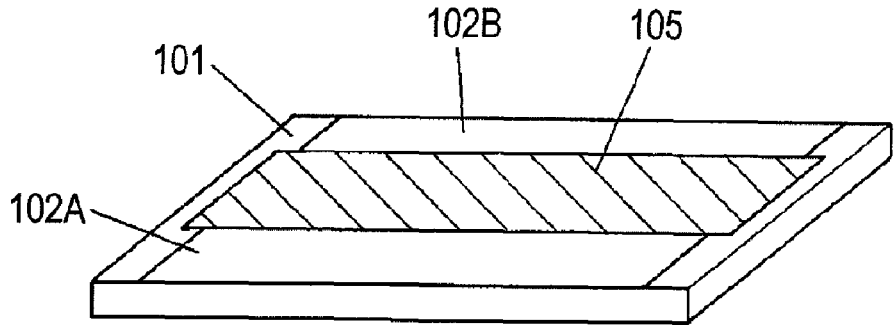
FIG. 16 is a perspective view of the ESD protector for illustrating a method for manufacturing the ESD protector in accordance with Embodiment 2.

Next, intermediate layer 105 is formed. Insulating powder having an average particle diameter ranging from 0.3 to 10 μm and made of $Al_2O_3$, $SiO_2$, MgO, or composite oxide thereof is prepared. This insulating powder, silicone-resin-based insulating resin, such as methyl silicone resin, and organic solvent are kneaded with a three-roll mill to disperse the insulating powder in the solvent, thereby providing insulating paste. As shown in FIG. 16, this insulating paste is applied by screen printing to have a thickness ranging from 5 to 50 μm so as to cover overvoltage protective layer 104. The insulating paste is applied to completely cover overvoltage protective layer 104 above gap 103. The applied insulating paste is dried at 150° C. for 5 to 15 minutes, thereby providing intermediate layer 105. In order to provide a sufficient resistance to electrostatic discharge, the sum of the thicknesses of overvoltage protective layer 104 and intermediate layer 105 after the drying is equal to or larger than 30 μm. If overvoltage protective layer 104 has a thickness large enough to provide the sufficient resistant to electrostatic discharge, the device does not necessarily include intermediate layer 105.

Figure 17:
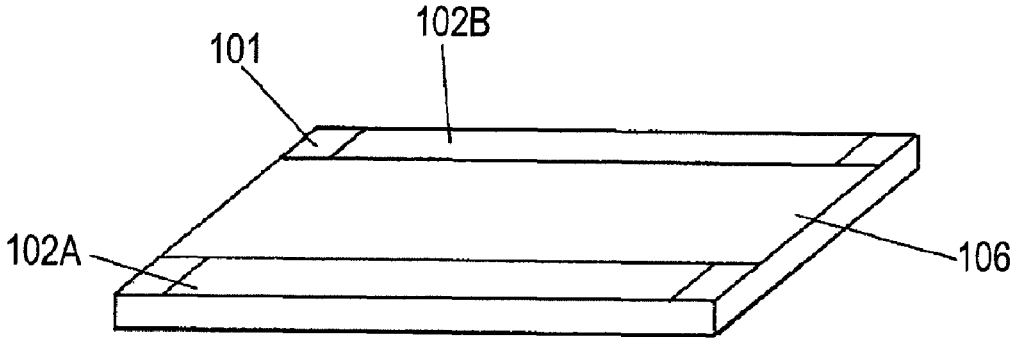
FIG. 17 is a perspective view of the ESD protector for illustrating a method for manufacturing the ESD protector in accordance with Embodiment 2.

Next, as shown in FIG. 17, resin paste made of resin, such as epoxy resin or phenol resin, is applied by screen printing to completely cover intermediate layer 105 such that ends 122A and 122B of electrodes 102A and 102B are exposed. The applied resin paste is dried at 150° C. for 5 to 15 minutes, and then cured at a temperature ranging from 150 to 200° C. for 15 to 60 minutes, thereby providing protective resin layer 106. The thickness of protective resin layer 106 after the drying ranges from 15 to 35 μm.

Figure 18:
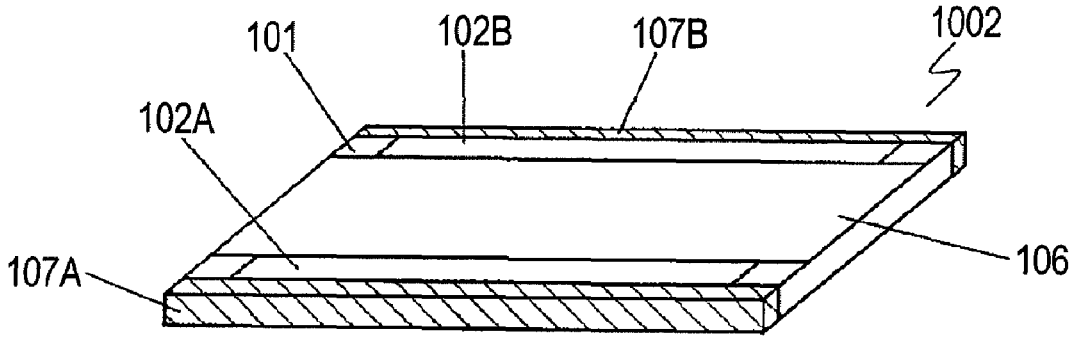
FIG. 18 is a perspective view of the ESD protector in accordance with Embodiment 2.

Next, as shown in FIG. 18, conductive paste containing powder of metal, such as Ag, and curing resin, such as epoxy resin, is applied onto long sides 101B and 101C of insulating resin 101, and dried and cured, thereby providing terminal electrodes 107A and 107B. Terminal electrodes 107A and 107B are connected to ends 122A and 122B of electrodes 102A and 102B, respectively, thus providing ESD protector 1002 according to Embodiment 2. ESD protector 1002 operates similarly to ESD protector 1001 according to Embodiment 1 shown in FIG. 1C. When a voltage applied between terminal electrodes 107A and 107B is lower than a predetermined rated voltage, the insulating resin in overvoltage protective layer 104 existing in gap 103 insulates between electrode 102A and 102B, thus electrically insulating between terminal electrodes 107A and 107B and opening the circuit between the terminals. When a high voltage caused by, e.g. an electrostatic pulse is applied between terminal electrodes 107A and 107B, a discharge current flows between the conductive particles dispersed in the insulating resin of overvoltage protective layer 104, thus drastically decreasing impedance between terminal electrodes 107A and 107B. The current generated by the high voltage accordingly flows to a ground via ESD protector 1002, as the discharge current in ESD protector 1002. The ESD protector allows the current generated by an abnormal voltage, such as an electrostatic pulse or surge, to bypass an electronic component and flow to the ground.

Fifty pieces of a comparative example of an ESD protector having gaps formed by a photolithography technique were fabricated. While a voltage of DC 15V is applied, insulation resistances of the samples of the comparative example and fifty samples of ESD protector 1001 according to Embodiment 2 were measured for finding out insulation resistance failure. Further, for the samples of the comparative example of the device and the device according to Embodiment 2, peak voltages were measured under conditions of experiment corresponding to human body model in accordance with IEC61000 (a discharge resistance of 330Ω, a discharge capacitance of 150 pF, and the applied voltage of 8 kV).

Two samples out of the fifty samples of the comparative example exhibited the insulation resistance failures. In contrast, none of the samples of ESD protector 1002 according to Embodiment 2 exhibited insulation resistance failure, thus improving a yield rate. The average value of peak voltages applied to the samples of the comparative example was 345 V. The average value of peak voltages applied to the samples of ESD protector 1002 according to Embodiment 2 was 330V, which is lower than that of the comparative example. Thus, ESD protector 1002 having more stable characteristics of suppressing electrostatic discharge (ESD) is provided. In ESD protector 1002 according to Embodiment 2, electrodes 102A and 102B are made of material containing more than 80 wt % of gold, i.e. mainly containing gold, and gap 103 is formed by cutting conductive layer 102 with laser. This method provides gap 103 reliably and precisely.

Exemplary Embodiment 3

Figure 19A:
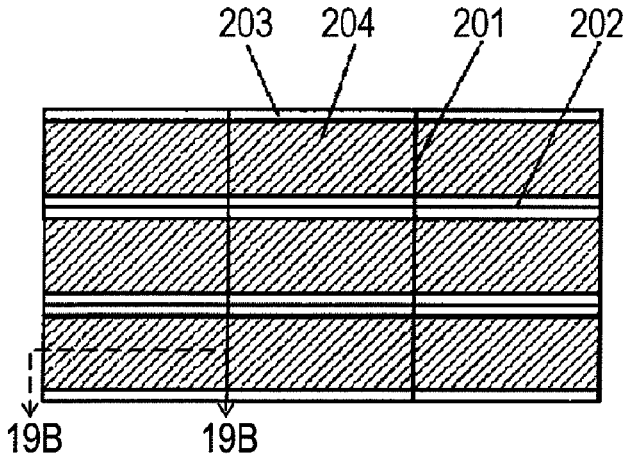
FIG. 19A is a top view of an ESD protector for illustrating a method for manufacturing the ESD protector in accordance with Exemplary Embodiment 3 of the invention.
Figure 19B:
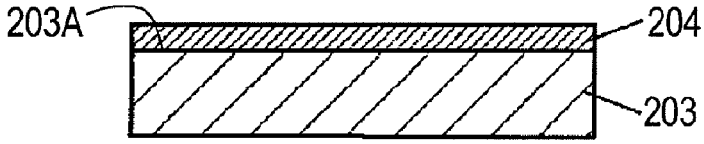
FIG. 19B is a sectional view of the ESD protector at line 19B-19B shown in FIG. 19A.
Figure 19C:
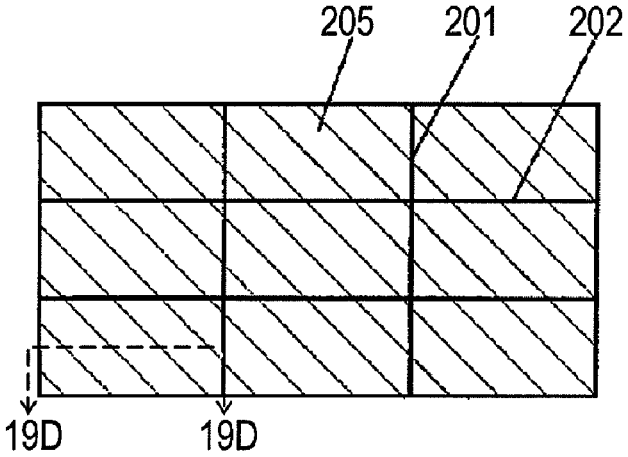
FIG. 19C is a top view of the ESD protector for illustrating the method for manufacturing the ESD protector in accordance with Embodiment 3.
Figure 19D:
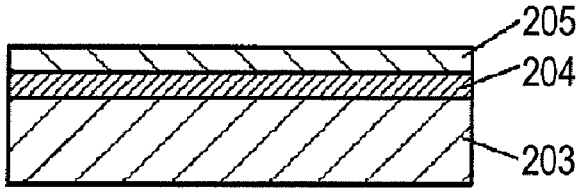
FIG. 19D is a sectional view of the ESD protector at line 19C-19D shown in of FIG. 19C.
Figure 19E:
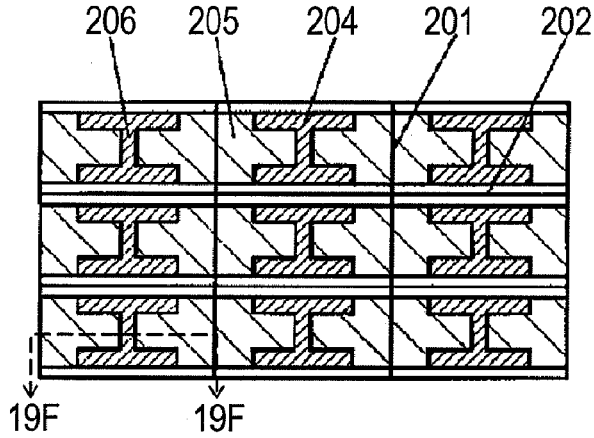
FIG. 19E is a top view of the ESD protector for illustrating the method for manufacturing the ESD protector in accordance with Embodiment 3.
Figure 19F:
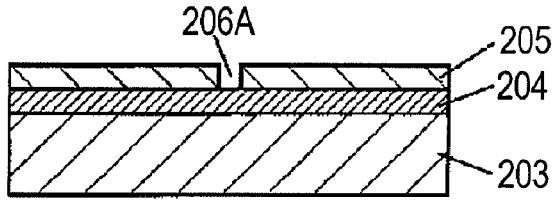
FIG. 19F is a sectional view of the ESD protector at line 19F-19F shown in FIG. 19E.

FIGS. 19A, 19C, and 19E are top views of an ESD protector according to Exemplary Embodiment 3 for illustrating a method of manufacturing the ESD protector. FIGS. 19B, 19D, and 19F are sectional views of the ESD protector at lines 19B-19B, 19D-19D, and 19F-19F shown in FIGS. 19A, 19C, and 19E, respectively.

Low-dielectric material, such as alumina, having a dielectric constant equal to or smaller than 50, preferably smaller than 10, is fired at a temperature ranging from 900 to 1600° C., thereby providing insulating substrate 203 having a sheet shape.

As shown in FIGS. 19A and 19B, plural first dividing lines 201 and plural second dividing lines 202 crossing first dividing lines 201 perpendicularly to lines 201 are defined on upper surface 203A of insulating substrate 203 having the sheet shape. First dividing lines 201 are parallel to each other. Second dividing lines 202 are parallel to each other. Dividing grooves may be formed in upper surface 203A of insulating substrate 203 along first dividing lines 201 and second dividing lines 202. Conductive paste made of gold resinate is applied onto upper surface 203A of insulating substrate 203 by screen printing to have a strip shape, and fired, thereby providing conductive layer 204. Conductive layer 204 is located away from second dividing lines 202, and crosses first dividing lines 201. Conductive layer 204 has a thickness ranging from 0.2 μm to 2.0 μm, thus being thin.

Next, as shown in FIGS. 19C and 19D, photosensitive resist 205 is applied to cover upper surface 203A of insulating substrate 203 and conductive layer 204. According to Embodiment 3, novolac-based positive photoresist is used for photosensitive resist 205.

Next, as shown in FIGS. 19E and 19F, resist 205 applied to insulating substrate 203 is exposed through a mask pattern and developed so as to remove an unnecessary portion of the resist, thereby forming a pattern for forming the electrodes in resist 205. This pattern includes gaps 206A.

Figure 20A:
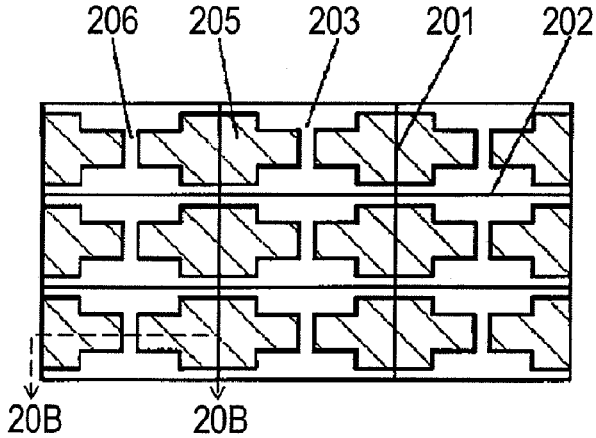
FIG. 20A is a top view of the ESD protector for illustrating the method for manufacturing the ESD protector in accordance with Embodiment 3.
Figure 20B:
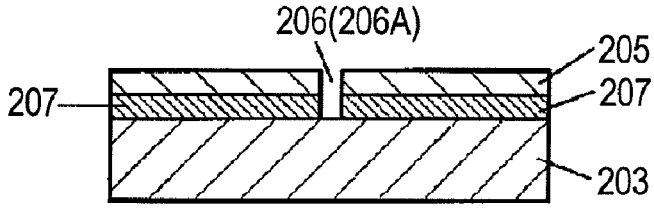
FIG. 20B is a sectional view of the ESD protector at line 20B-20B shown in FIG. 20A.
Figure 20C:
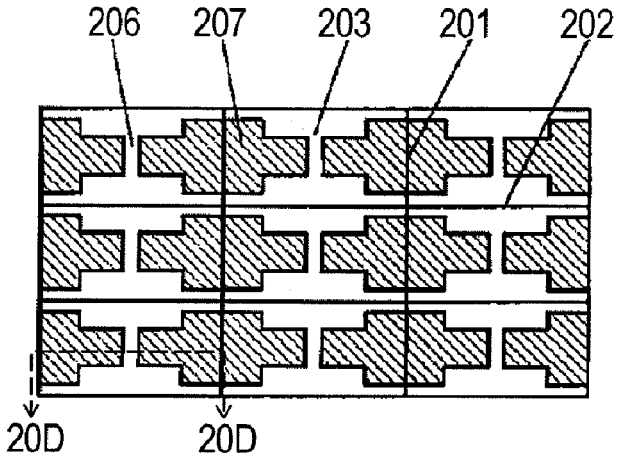
FIG. 20C is a top view of the ESD protector for illustrating the method for manufacturing the ESD protector in accordance with Embodiment 3.
Figure 20D:
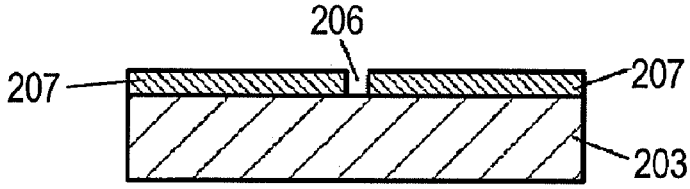
FIG. 20D is a sectional view of the ESD protector at line 20D-2D shown in FIG. 20C.
Figure 20E:
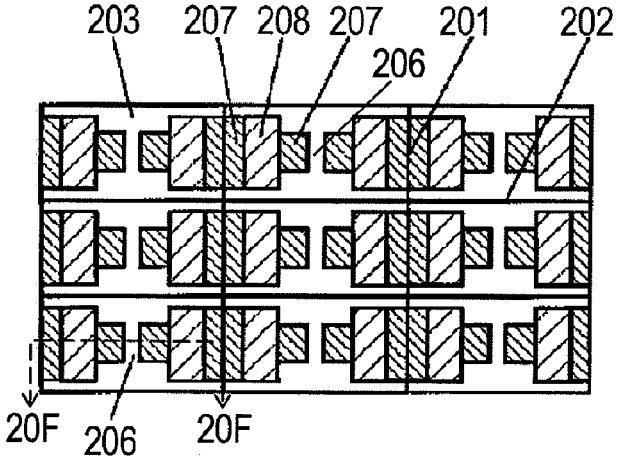
FIG. 20E is a top view of the ESD protector for illustrating the method for manufacturing the ESD protector in accordance with Embodiment 3.
Figure 20F:
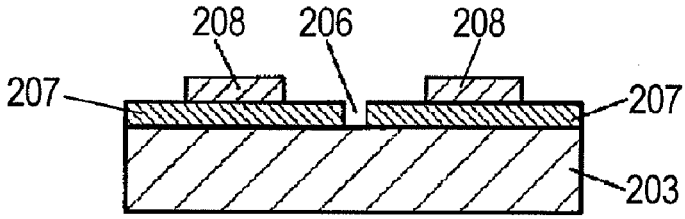
FIG. 20F is a sectional view of the ESD protector at line 20E-20F shown in FIG. 20E.

FIGS. 20A, 20C, and 20E are top views of the ESD protector according to Embodiment 3 for illustrating the method for manufacturing the ESD protector. FIGS. 20B, 20D, and 20F are sectional views of the ESD protector at lines 20B-20B, 20D-20D, and 20E-20F shown in FIGS. 20A, 20C, and 20E, respectively.

Next, as shown in FIGS. 20A and 20B, the unnecessary portion of conductive layer 204 are removed by etching layer 204 through resist 205 with etching solution mainly containing iodine and potassium iodine, thereby providing electrodes 207. Electrodes 207 face each other across gaps 206 each having a width of approximately 10 μm. If portions of conductive layer 204 along second dividing lines 202 remains, electrodes 207 are electrically connected to each other and thus short-circuited. In the case that the dividing grooves are formed in upper surface 203A of insulating substrate 203 along dividing lines 201 and 202, portions of conductive layer 204 in the dividing grooves along first dividing lines 201 may not be removed completely by the etching. However, conductive layer 204 is located away from second dividing lines 202 and does not cross second dividing lines 202, thus allowing conductive layer 204 not to exist in the dividing grooves along second dividing lines 202. This prevents short circuits between electrodes 207.

Next, as shown in FIGS. 20C and 20D, resist 205 is removed from insulating substrate 203 with resist-removing agent so as to expose electrodes 207. Then, appearance of electrodes 207 is checked particularly in whether or not the widths of gaps 206 have variations.

Next, as shown in FIGS. 20E and 20F, resin silver paste is applied, by screen printing to have a thickness ranging from 3 to 20 μm, onto a portion of each electrode 207 away from first dividing lines 201 and second dividing lines 202, and dried at a temperature ranging from 100 to 200° C. for 5 to 15 minutes, thereby providing upper electrodes 208. Ends 2207 of electrodes 207 contacting first dividing lines 201 are exposed from upper electrodes 208.

Figure 21A:
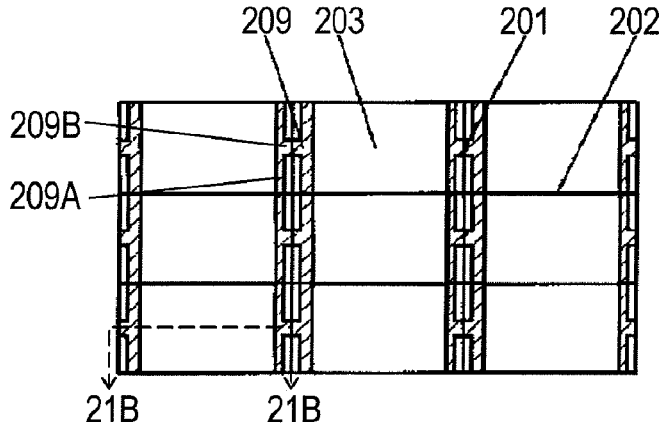
FIG. 21A is a bottom view of the ESD protector for illustrating the method for manufacturing the ESD protector in accordance with Embodiment 3.
Figure 21B:
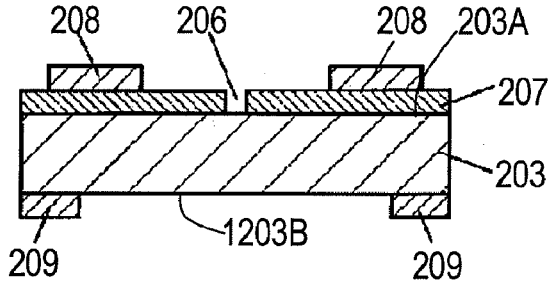
FIG. 21B is a sectional view of the ESD protector at line 21B-21B shown in FIG. 21A.

FIG. 21A is a bottom view of the ESD protector according to Embodiment 3 for illustrating the method for manufacturing the ESD protector. FIG. 21B is a sectional view of the ESD protector at line 21B-21B shown in FIG. 21A. Insulating substrate 203 has lower surface 1203B opposite to upper surface 203A. Resin silver paste is applied to lower surface 1203B of insulating substrate 203 by screen printing to have a thickness ranging from 3 to 20 μm, and dried at a temperature ranging from 100 to 200° C. for 5 to 15 minutes, thereby providing lower electrodes 209. Lower electrodes 209 face electrodes 207 across insulating substrate 203. Lower electrodes 209 cross first dividing lines 201 and second dividing lines 202. Each of lower electrodes 209 includes first portion 209A which crosses second dividing lines 202, and second portion 209B which is connected to first portion 209A and which crosses first dividing line 201. First portion 209A bridges between second dividing lines 202 adjacent to each other. The width of second portion 209B of lower electrodes 209 is narrower than the width of first portion 209A, and thus, lower electrode 209 has a T-shape. In other words, lower electrode 209 is located away from a portion of first dividing line 201. This shape prevents lower electrodes 209 from having burrs protruding therefrom when insulating substrate 203 is divided along first dividing lines 201.

Figure 21C:
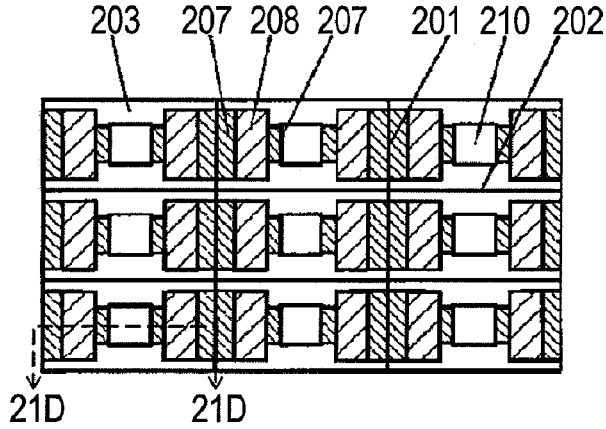
FIG. 21C is a top view of the ESD protector for illustrating the method for manufacturing the ESD protector in accordance with Embodiment 3.
Figure 21D:
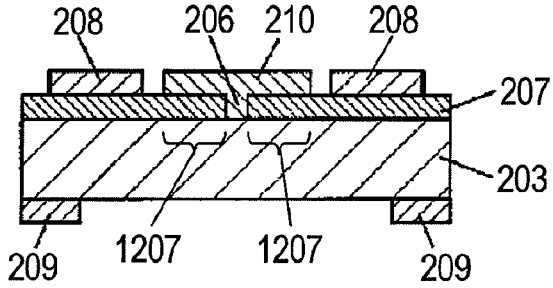
FIG. 21D is a sectional view of the ESD protector at line 21D-21D shown in FIG. 21C.
Figure 21E:
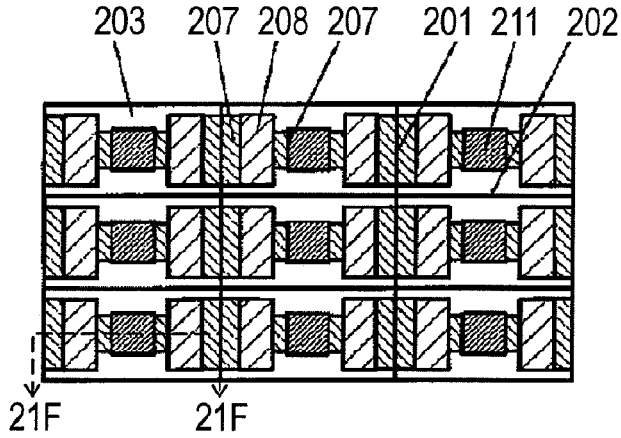
FIG. 21E is a top view of the ED protector for illustrating the method for manufacturing the ESD protector in accordance with Embodiment 3.
Figure 21F:
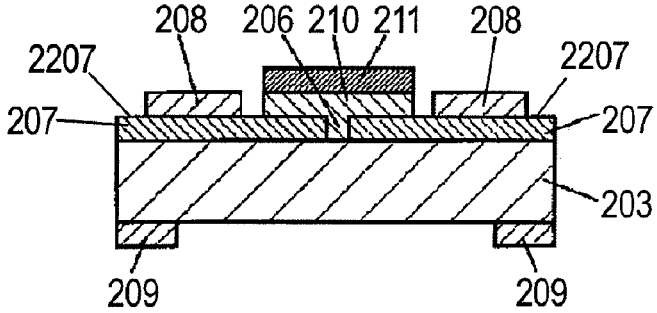
FIG. 21F is a sectional view of the ESD protector at line 21F-21F shown in FIG. 21E.

FIGS. 21C and 21E are top views of the ESD protector in accordance with Embodiment 3 for illustrating the method for manufacturing the ESD protector. FIGS. 21D and 21F are sectional views of the ESD protector at line 21D-21D and 21F-21F shown in FIGS. 21C and 21E, respectively.

Conductive particles having spherical shapes having an average particle diameter ranging from 0.3 to 10 μm and made of metal powder, such as Ni, Al, Ag, Pd, or Cu, is prepared. The conductive particles, silicone-based resin, such as methyl silicone resin, and organic solvent are kneaded with a three-roll mill to disperse the conductive particles, thereby providing overvoltage protective material paste. As shown in FIGS. 21C and 21D, the overvoltage protective material paste is applied by screen printing to have a thickness ranging from 5 to 50 μm so as to cover gaps 206 and portions 1207 of electrodes 207, and dried at 150° C. for 5 to 15 minutes, thereby providing overvoltage protective layer 210.

Insulating powder having an average particle diameter ranging from 0.3 to 10 μm and made of $Al_2O_3$, $SiO_2$, MgO, or composite oxide thereof is prepared. This insulating powder, silicone-based resin, such as methyl silicone resin, and organic solvent are kneaded with a three-roll mil to disperse the insulating powder, thereby providing insulating paste. As shown in FIGS. 21E and 21F, this insulating paste is applied by screen printing to have a thickness ranging from 5 to 50 μm so as to cover overvoltage protective layer 210, and dried at 150° C. for 5 to 15 minutes, thereby providing intermediate layer 211. Intermediate layer 211 completely covers portions of overvoltage protective layer 210 over gaps 206. In order to provide a sufficient resistance to electrostatic discharge, the sum of the thicknesses of overvoltage protective layer 210 and intermediate layer 211 is preferably equal to or larger than 30 μm after the drying. In the case that overvoltage protective layer 210 has a thickness enough to allow resistance to electrostatic discharge to satisfy predetermined conditions, intermediate layer 211 is not necessarily be formed.

Figure 22A:
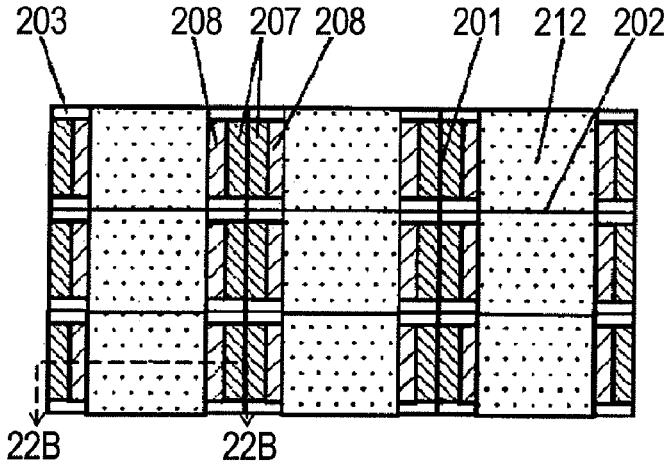
FIG. 22A is a top view of the ESD protector for illustrating the method for manufacturing the ESD protector in accordance with Embodiment 3.
Figure 22B:
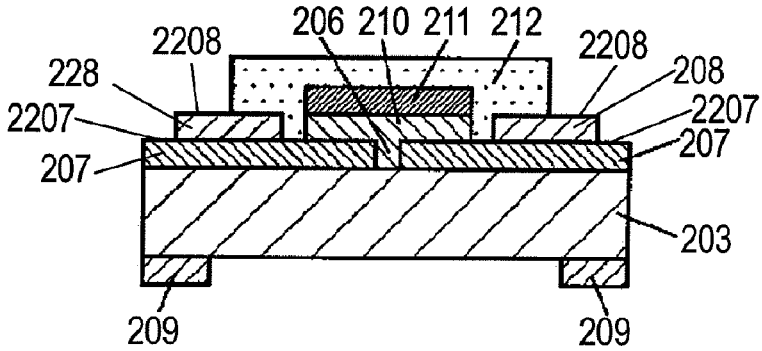
FIG. 22B is a sectional view of the ESD protector at line 22B-22B shown in FIG. 22A.
Figure 22C:
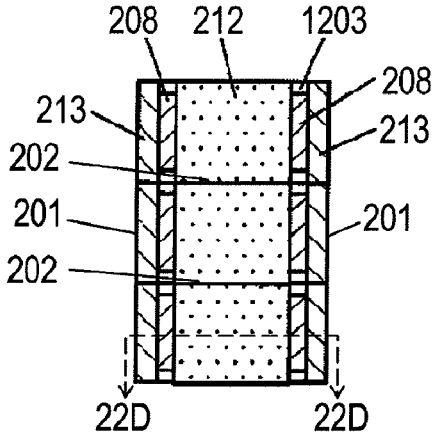
FIG. 22C is a top view of the ESD protector for illustrating the method for manufacturing the ESD protector in accordance with Embodiment 3.
Figure 22D:
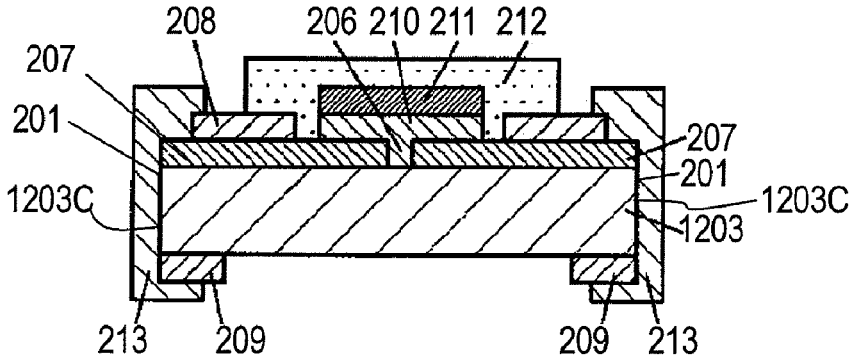
FIG. 22D is a sectional view of the ESD protector at line 22D-22D shown in FIG. 22C.
Figure 22E:
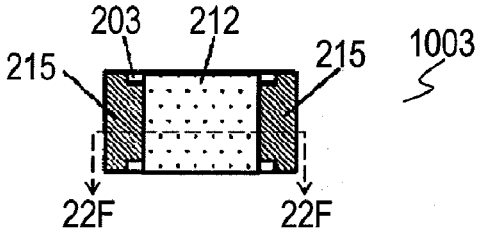
FIG. 22E is a top view of the ESD protector for illustrating the method for manufacturing the ESD protector in accordance with Embodiment 3.
Figure 22F:
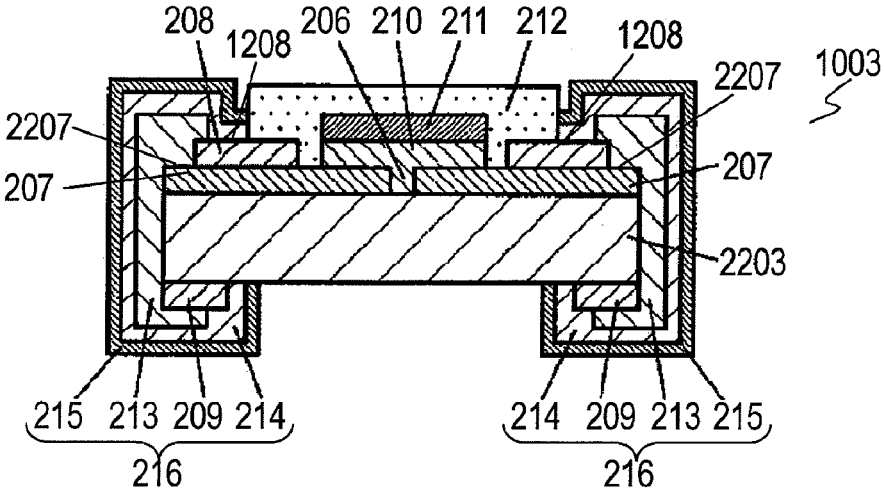
FIG. 22F is a sectional view of the ESD protector at line 22F-22F shown in FIG. 22E.

FIGS. 22A, 22C, and 22E are top views of the ESD protector in accordance with Embodiment 3 for illustrating the method for manufacturing the ESD protector. FIGS. 22B, 22D, and 22F are sectional views of the ESD protector at lines 22B-22B, 22D-22D, and 22F-22F shown in FIGS. 22A, 22C, and 22E, respectively.

Next, as shown in FIGS. 22A and 22B, resin paste made of insulating resin, such as epoxy resin or phenol resin, is applied by screen printing to completely cover overvoltage protective layer 210 and intermediate layer 211. The applied resin paste is dried at 150° C. for 5 to 15 minutes, and then, cured at a temperature ranging from 150 to 200° C. for 15 to 60 minutes, thereby providing protective resin layer 212. The thickness of protective resin layer 212 ranges from 15 to 35 μm. End 2207 of electrode 207 contacting first dividing lines 201 and portion 2208 of upper electrode 208 are exposed from protective resin layer 212.

Next, as shown in FIGS. 22C and 22D, substrate 203 is divided into insulating substrate strips 1203 by dicing substrate 203 along first dividing lines 201. Resin silver paste is applied onto edge surfaces 1203C along first dividing lines 201 of each insulating substrate strip 1203, thereby providing edge electrodes 213 electrically connected to electrodes 207, upper electrodes 208, and lower electrodes 209.

Next, as shown in FIGS. 22E and 22F, insulating substrate strip 1203 is divided along second dividing lines 202 into insulating substrate pieces 2203. Then, nickel-plated layers 214 are formed by barrel plating to cover edge electrodes 213, lower electrodes 209, and upper electrodes 208 so that these electrodes are not exposed. Then, tin-plated layers 215 covering nickel-plated layers 214 are formed by barrel plating to provide terminal electrodes 216, thus providing ESD protector 1003 according to Embodiment 3.

ESD protector 1003 operates similarly to ESD protector 1001 according to Embodiment 1 shown in FIG. 1C. When a voltage applied between terminal electrodes 216 is lower than a predetermined rated voltage, the insulating resin of overvoltage protective layer 210 existing in gap 206 insulates between electrodes 207, thus electrically insulating between terminal electrodes 216 and opening the circuit between the terminal electrodes. When a high voltage caused by, e.g. an electrostatic pulse is applied between terminal electrodes 216, a discharge current flows between the conductive particles dispersed in the insulating resin of overvoltage protective layer 210, thus drastically decreasing impedance between terminal electrodes 216. The current generated by the high voltage accordingly flows to a ground via ESD protector 1003, as the discharge current in ESD protector 1003. The ESD protector allows the current generated by an abnormal voltage, such as an electrostatic pulse or surge, to bypass an electronic component and flow to the ground.

In ESD protector 1003 according to Embodiment 3, conductive layer 204 is formed by applying gold resinate paste onto insulating substrate 203 so that the paste crosses first dividing lines 201. Since conductive layer 204 for forming electrodes 207 is made of gold-based material, the electrodes are more resistant to sulfidation than electrodes made of silver or copper, providing ESD protector 1003 with high resistance to sulfidation. Further, the gold resinate paste is applied and fired to provide thin conductive layer 204 for forming electrodes 207. Thus, when insulating substrate 203 is divided into insulating substrate strips 1203 by dicing the substrate along first dividing lines 201, insulating substrate 203 is prevented from producing burrs on electrodes 207, accordingly providing ESD protector 1003 with a small size and a stable shape.

In ESD protector 1003 according to Embodiment 3, overvoltage protective layer 210 is covered with intermediate layer 211, and intermediate layer 211 and overvoltage protective layer 210 are completely covered with protective resin layer 212. This structure prevents insulation of protective resin layer 212 from deteriorating due to an electrostatic pulse applied thereto.

Further, in ESD protector 1003 according to Embodiment 3, a portion of electrode 207 is covered with upper electrode 208. When ESD protector 1003 is mounted on a circuit board, solder may flow into a gap between tin-plated layer 215 and protective resin layer 212. The solder reaches upper electrode 208 and stops. If the solder reaches electrode 207, metallic components of electrode 207 may flow to the solder and increase the resistance of electrode 207. Upper electrode 208 prevents the solder from reaching electrode 207, and thus prevents a decrease in the effect of suppressing electrostatic electricity caused by the increased resistance of electrode 207, thus providing ESD protector 1003 with a stable effect of suppressing static electricity.

According to Embodiment 3, the sides of insulating substrate 2203 along first dividing lines 201 and second dividing lines 202 are the short sides and long sides, respectively. Electrodes 207 reach the short sides of insulating substrate 2203. In the case that the sides along first dividing lines 201 and second dividing lines 202 are the long sides and short sides, respectively, the method of manufacturing ESD protector 1003 according to Embodiment 3 can provide ESD protectors 1001 and 1002 according to Embodiments 1 and 2 shown in FIGS. 1A and 18.

Industrial Applicability

A manufacturing method forms a gap with a narrow width precisely, and provides an ESD protector having a low peak voltage, stable characteristics of suppressing electrostatic discharge (ESD), and a high resistance to sulfidation, and is useful particularly to a method for manufacturing a component for protecting an electronic device to which an electrostatic pulse having a high voltage is applied.

The invention claimed is:

1. A method of manufacturing an electrostatic discharge (ESD) protector, the method comprising:

forming a conductive layer mainly made of gold on an upper surface of an insulating substrate;

forming a plurality of electrodes facing each other via a gap by forming the gap in the conductive layer;

forming an overvoltage protective layer covering the gap and a portion of each of the electrodes;

forming an intermediate layer covering the overvoltage protective layer; and forming a protective resin layer completely covering the intermediate layer and the overvoltage protective layer, wherein the protective resin layer has a physical breaking strength higher than a physical breaking strength of the intermediate layer, and wherein the intermediate layer comprises silicone-resin-based insulating resin and insulating powder made of $Al_2O_3$, $SiO_2$, MgO, a composite oxide of $Al_2O_3$, a composite oxide of $SiO_2$, or a composite oxide of MgO.

2. The method according to claim 1, wherein said forming the plurality of electrodes comprises forming the gap in the conductive layer by a photolithography technique.

3. The method according to claim 1, wherein said forming the plurality of electrodes comprises forming the gap with laser.

4. The method according to claim 3, further comprising cleaning the gap with acidic solution.

5. The method according to claim 1, wherein the conductive layer is made of gold-based organic paste.

6. A method of manufacturing an electrostatic discharge (ESD) protector, the method comprising:

defining a first dividing line and a plurality of second dividing lines crossing in an upper surface of an insulating substrate, the plurality of second dividing lines crossing the first dividing line;

forming a conductive layer mainly made of gold on the upper surface of the insulating substrate;

forming a plurality of electrodes facing each other via a gap by forming the gap in the conductive layer;

forming a plurality of lower electrodes on a lower surface of the insulating substrate;

forming an overvoltage protective layer covering the gap and a portion of each of the electrodes;

forming an intermediate layer covering the overvoltage protective layer;

forming a protective resin layer completely covering the intermediate layer and the overvoltage protective layer;

providing an insulating substrate strip by dividing the insulating substrate along the first dividing line; and providing an insulating substrate piece by dividing the insulating substrate strip along the plurality of second dividing lines, wherein said forming the conductive layer comprises forming the conductive layer on the upper surface of the insulating substrate so that the conductive layer crosses the first dividing line, wherein each of the lower electrodes includes a first portion which crosses the plurality of second dividing lines, and a second portion connected to the first portion, the second portion crossing the first dividing line, the second portion having a width narrower than a width of the first portion, the second portion being disposed away from the plurality of second dividing lines, and wherein the protective resin layer has a physical breaking strength higher than a physical breaking strength of the intermediate layer, and wherein the intermediate layer comprises silicone-resin-based insulating resin and insulating powder made of $Al_2O_3$, $SiO_2$, MgO, a composite oxide of $Al_2O_3$, a composite oxide of $SiO_2$, or a composite oxide of MgO.

7. The method according to claim 6, wherein said forming the conductive layer comprises forming the conductive layer on the upper surface of the insulating substrate so that the conductive layer crosses the first dividing line and is located away from the second dividing lines.

8. The method according to claim 6, wherein said forming the plurality of electrodes comprises:

forming the conductive layer by applying conductive paste on the upper surface of the insulating substrate;

applying a resist to the conductive layer;

forming a pattern in the resist by exposing the resist to light through a mask pattern, developing the resist, and removing an unnecessary portion of the resist;

after said forming the pattern in the resist, forming the gap by etching the conductive layer; and after said forming the gap, removing the resist.

9. The method according to claim 6, further comprising forming a protective resin layer completely covering the overvoltage protective layer.

10. The method according to claim 9, further comprising forming an intermediate layer covering the overvoltage protective layer, wherein said forming the protective resin layer comprises completely covering the intermediate layer and the overvoltage protective layer with the protective resin layer.

11. The method according to claim 6, further comprising:

forming an upper electrode for covering a portion of one of the plurality of electrodes;

after said providing the insulating substrate strip, forming an edge electrode on an edge surface of the substrate strip, the edge electrode being connected electrically to the upper electrode and said one of the electrodes; and after said providing the insulating substrate piece, forming a plated layer on the edge electrode.

12. An electrostatic discharge (ESD) protector, comprising:

an insulating substrate having a surface, the insulating substrate having a rectangular shape having a first long side, a second long side, a first short side, and a second short side;

a first electrode provided on the surface of the insulating substrate and extending along the first long side;

a second electrode provided on the surface of the insulating substrate and extending along the second long side, the second electrode facing the first electrode via a gap;

an overvoltage protective layer covering a portion of the first electrode, a portion of the second electrode, and the gap;

an intermediate layer covering the overvoltage protective layer; and a protective resin layer having a thickness equal to or larger than 20 μm, the protective resin layer completely covering the overvoltage protective layer and the intermediate layer, wherein the protective resin layer has a physical breaking strength higher than a physical breaking strength of the intermediate layer, and wherein the intermediate layer comprises silicone-resin-based insulating resin and insulating powder made of $Al_2O_3$, $SiO_2$, MgO, a composite oxide of $Al_2O_3$, a composite oxide of $SiO_2$, or a composite oxide of MgO.

13. The ESD protector according to claim 12, wherein a thickness of the protective resin layer is equal to or larger than 35 μm.

14. The ESD protector according to claim 12, wherein a length L (mm) of each of the first long side and the second long side of the insulating substrate, and a length W (mm) of each of the first short side and the second short side of the insulating substrate satisfy a condition:

$$(L-0.1)/(W-0.1) \geqq 1.5.$$

15. The method according to claim 1, wherein the insulating substrate has a rectangular shape having a first long side, a second long side, a first short side, and a second short side, and wherein a length L (mm) of each of the first long side and the second long side of the insulating substrate, and a length W (mm) of each of the first short side and the second short side of the insulating substrate satisfy a condition:

$$(L-0.1)/(W-0.1) \geqq 1.5.$$

16. A method of manufacturing an electrostatic discharge (ESD) protector, the method comprising:

forming a conductive layer mainly made of gold on an upper surface of an insulating substrate;

forming first and second electrodes facing each other via a gap by forming the gap in the conductive layer;

forming an overvoltage protective layer covering the gap and a portion of each of the first and second electrodes;

forming first and second upper electrodes on portions of upper surfaces of the first and second electrodes, respectively;

forming an intermediate layer covering the overvoltage protective layer;

forming a protective resin layer completely covering the overvoltage protective layer, the protective resin layer extending partially onto the upper surfaces of the first and second upper electrodes;

forming a first terminal electrode on the first electrode and on a portion of the first upper electrode; and forming a second terminal electrode on the second electrode and on a portion of the second upper electrode, wherein the protective resin layer has a physical breaking strength higher than a physical breaking strength of the intermediate layer, and wherein the intermediate layer comprises silicone-resin-based insulating resin and insulating powder made of $Al_2O_3$, $SiO_2$, MgO, a composite oxide of $Al_2O_3$, a composite oxide of $SiO_2$, or a composite oxide of MgO.

17. The method according to claim 16, wherein the insulating substrate has a rectangular shape having a first long side, a second long side, a first short side, and a second short side, and wherein a length L (mm) of each of the first long side and the second long side of the insulating substrate, and a length W (mm) of each of the first short side and the second short side of the insulating substrate satisfy a condition:

$$(L-0.1)/(W-0.1) \geqq 1.5.$$

* * * * *